United States Patent [19]

Leupold

[11] Patent Number: 4,654,618

[45] Date of Patent: Mar. 31, 1987

[54] CONFINEMENT OF KOE MAGNETIC FIELDS TO VERY SMALL AREAS IN MINIATURE DEVICES

[75] Inventor: Herbert A. Leupold, Eatontown, N.J.

[73] Assignee: The United States of America as represented by the Secretary of the Army, Washington, D.C.

[21] Appl. No.: 861,462

[22] Filed: May 1, 1986

[51] Int. Cl.[4] ..... H01F 7/02

[52] U.S. Cl. ..... 335/304; 335/214; 335/306

[58] Field of Search ..... 335/214, 211, 301, 302, 335/304, 306

[56] References Cited

U.S. PATENT DOCUMENTS

| | | | |
|---|---|---|---|
| 3,182,234 | 5/1965 | Meyerer | 335/214 X |
| 3,205,415 | 9/1965 | Seki et al. | 335/301 X |
| 3,227,931 | 1/1966 | Adler | 335/304 |
| 3,237,059 | 2/1966 | Meyerer | 335/306 X |
| 4,578,663 | 3/1986 | Sanders et al. | 335/210 X |
| 4,580,120 | 4/1986 | Jacquot | 335/214 X |

*Primary Examiner*—George Harris

*Attorney, Agent, or Firm*—Sheldon Kanars; Jeremiah G. Murray; Maurice W. Ryan

[57] ABSTRACT

A rare earth permanent magnetic apparatus for the containment and control without any substantial loss of field flux comprising electro-deposited layers of rare earth magnetic material disposed and laid up around a ferrite center core element, the first or inner layer comprising a uniformly thick supply magnet to produce the magnetic field to be controlled, and the second or cladding magnet constituting a layer of diminishing thickness from the outboard ends of the device towards and to the plane of zero magnetic potential at or near the middle of the device.

5 Claims, 2 Drawing Figures

CONFINEMENT OF KOE MAGNETIC FIELDS TO VERY SMALL AREAS IN MINIATURE DEVICES

The invention described herein may be manufactured, used, and licensed by or for the Government of the United States of America for governmental purposes without the payment to me of any royalties thereon.

BACKGROUND AND FIELD OF THE INVENTION

This invention relates to the technology of magnetic circuits for electronic devices, particularly to the adaptation and utilization of permanent magnets rather than electromagnets in applications for such devices and, more particularly, to the use of rare earth permanent magnet materials in the construction of apparatus for the production of axially extending electromagnetic fields and for the precise control and leakage-free containment thereof.

The utilization of permanent magnet devices and structures of permanent magnets to replace electromagnetic type yokes in electronic devices, cathode ray tubes for instance, has received significant acceptance in the electronics industry. To achieve the proper operation of electron beam type devices it is most times necessary to apply a magnetic field having its flux lines parallel to the longitudinal axis of the travel path of the electrons being controlled. Conventionally, this space of electron travel assumes the shape of an elongate cylinder, and the flux lines to be developed parallel to the axis of such cylinder have been traditionally produced for many years by shielded solenoids. Such solenoids require extremely critical power regulation, and if the field strength is of a significant magnitude, cooling may be required. The power and cooling requirements of such electromagnetic and solenoid devices have been advantageously replaced by the present day developments in the use of permanent magnet structures to produce the longitudinally extending linear flux fields for the control of these electron beam streams. More recent advances in the art have found advantage in the application of the rare earth permanent magnet materials and, generally, permanent magnet materials characterized by having a square hysteresis feature.

Various prior art devices have contributed to the development of the technology in this area. The U.S. Pat. No. 3,768,054, for example, to Neugebauer, entitled "Low Flux Leakage Magnetic Construction", teaches a number of magnetic circuits and devices which utilize magnetic cladding means to reduce or contain the interior flux leakage and increase the controlled magnetic field intensity. The advantageous features of this and similar devices are, significantly, the reduction of flux loss and very effective control without any increase, in fact most times a decrease, in the size and weight of the magnetic circuit devices and elements.

In my own co-pending application Ser. No. 685,426, filed Dec. 24, 1984, entitled "Lightweight Cladding for Magnetic Circuits", I disclose and claim the advantageous features of certain magnetic structures arranged with flux fields transverse to each other and with tapered thicknesses of the restraining or cladding magnet elements in order effectively to control and maintain the linearity and constancy of the working flux in the flux spaces interior of such devices. In another co-pending application, application Ser. No. 861,464, filed May 1, 1986, and entitled "Confinement of Longitudinal Axially Symmetric Magnetic Fields to Annular Regions With Permanent Magnets", I describe and claim my invention relating to the provision of a device which produces a magnetic field, annular in shape using the basic design concept of arranging cladding magnets with flux directions transverse to the main supply magnet flux directions.

With the attainment of greater advances in the art the desideratum of further miniaturization of such devices has arisen. It is readily apparent that with steps taken towards the reduction of weight and size of the various magnetic elements comprised in these rare earth permanent magnet structures, the limits of miniaturization have not yet been fully developed or explored. Prior to the time of the present invention, the cladding magnet elements in the various structures described and referred to hereinabove have been made by shaping and forming cladding magnet elements and parts with the flux fields arranged in the desired transverse direction, and then applying or attaching these to the basic magnetic structure, whether it be concentric sleeves or simple cylindrical or square type structures. In some recent development work performed by F. J. Cadieu et al, described in the Journal of Applied Physics, 55–6, page 2611, 1984, and in further treatment of this area of the technology by F. J. Cadieu et al in later papers presented in August 1985, the concept of depositing relatively high energy product of rare earth permanent magnet material such as 18–21 $MGO_e$ and/or $SmCo_5$ type films onto various substrates, afforded an opportunity for the concept and development of my invention according to this application. Cadieu's work involved the formation of a magnetic device of film or strip form by the deposition method known as "Sputtering", and then forming a flux field or working space within such laid down film or strip by drilling a hole or a tunnel therethrough just beneath the deposited material. Of particular interest is the fact that the Cadieu type films laid down according to the sputtering technique can be deposited with orientations either parallel to or normal to the planes of their substrates.

With this then being the state of the art, I conceived and developed the present invention to provide for the control of linearly extending flux fields in very small magnetic devices utilizing permanent magnet structures.

It is a primary object of the present invention to provide a method and apparatus for permanent magnet structures made from rare earth materials and wherein magnetic flux fields can be controlled with great precision in very small physical environments substantially without the occurrence of flux leakage.

It is a further object of this invention to provide apparatus and method for the control of axially extending longitudinal magnetic flux fields, including particularly the containment thereof, by the application of varying or tapered thicknesses of permanent magnet depositions arranged and disposed along the length of the supply magnets of such devices and with the deposition material flux oriented transverse to the flux of the magnetic element which produces the axially extending field.

A still further object of the invention is to provide permanent magnet structures and a method for making them which involves the deposition of high energy rare earth magnetic field products in tapering thicknesses along the longitudinal dimension of basic magnetic elements within which axially extending magnetic flux fields exists.

It is a further and particular object of this invention to provide for the fabrication of extremely, heretofor unattainable, miniaturized permanent magnet structures by the technique of deposition of a magnetic layer of axial orientation flux on very small dimensioned cylindrical core thicknesses, in the order of the thickness of a human hair and the like, and, by means of the precise control of radially oriented flux layers deposition, obtain the control of magnetic fields in the order of a few thousand oersteds.

These and other objects, features, and details of the invention will become the more readily apparent in the light of the ensuing detailed disclosure, particularly in the light of the drawing wherein:

FIG. 1 is an isometric view of a cutaway elevation of a permanent magnet device according to the present invention; and FIG. 2 is an isometric view of a cylindrical embodiment of apparatus according to the invention, shown partially cut away at the left end to detail the interior thereof.

SUMMARY OF THE INVENTION

In general, the invention comprehends a permanent magnet structure comprising a core structure of longitudinally extending permanent magnetic material having a square hysteresis loop feature and, in exterior contact therewith, deposited layers of rare earth permanent magnetic material varying in thickness from a plane of zero flux potential to a plane of maximum flux potential and with the flux orientation therein extending in a transverse direction to the flux orientation in the basic core magnet. In a particular embodiment of apparatus according to my invention, there is provided a square or rectangularly cross sectioned center or core element which will contain the magnetic field of interest; a substantially uniform thickness supply magnet layer deposited on said core with a flux orientation aligned with the axially extending magnetic field; tapered thickness depositions of a sputtered on rare earth magnetic material extending from each end of the core element, diminishing in thickness towards and to the zero potential center plane of the device; end plate magnets defining closures; and bucking magnets arranged and disposed at each end of the assembled core structure and sputtered on cladding magnet structure.

In an alternative embodiment of my invention a cylindrical tube defines the supply magnet structure, the hollow space interiorly thereof being field space, and with a series of deposited ring like depositions arranged from end to end, said structures being thicker radially at the ends of the device and diminishing towards and to a minimal thickness at the zero flux potential plane of the device.

DETAILED DESCRIPTION

Figure 1:
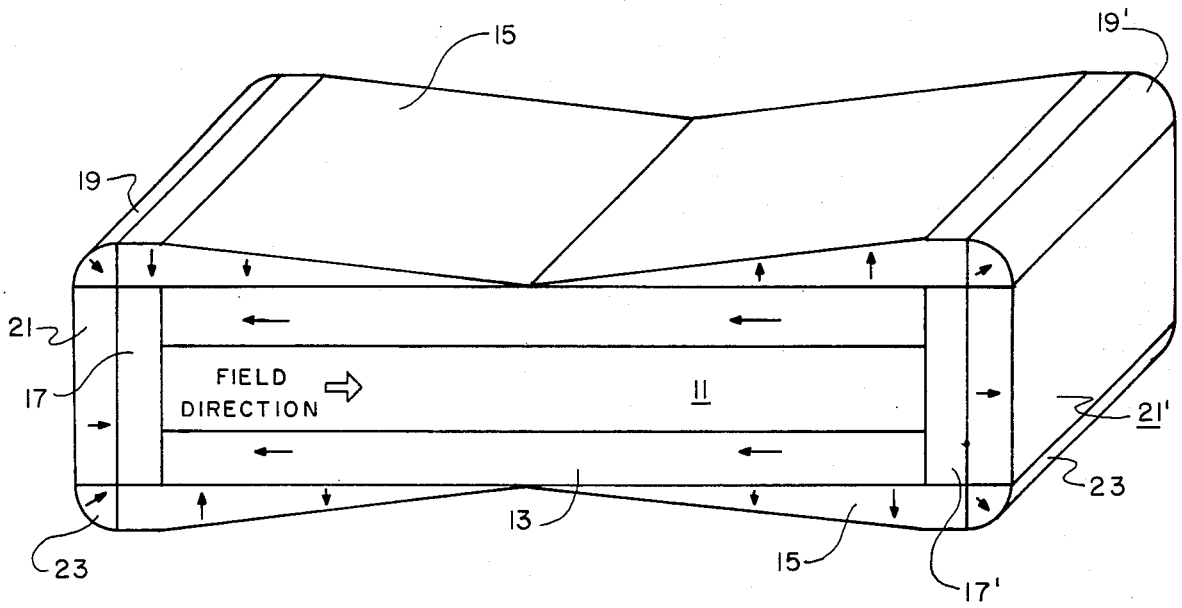

With reference to FIG. 1 of the drawing, a magnetic device according to the present invention is shown comprising a ferrite core 11 formed in the shape and size of the working space of the field which it is desired to produce. In the illustrated embodiment, the ferrite strip would be elongate and square or rectangular in crossection. This element 11 defines the core of the magnetic device of the invention.

A supply magnet 13 layer of even thickness deposited ferromagnetic rare earth material is sputtered onto the entire exterior surface(s) of the core element 11, except for the end sections thereof. This deposited layer provides the linear flux necessary to produce the field in the ferrite strip 11. Tapered cladding magnet layers 15 are sputtered or electro-deposited on the outer surfaces of the supply magnet 13 layer as shown. The cladding magnet layers 15 begin with maximum thickness at the outermost ends of the device and diminish in thickness, through controlled deposition techniques of the rare earth material layers being deposited, towards and to a minimal thickness (or zero thickness) at the midpoint of the device, which is also the point of zero magnetic potential. The cladding magnet layers 15 are deposited over the entire exterior longitudinal surfaces of the combination thus far described.

Closure plates 17, 17', are provided at each end of the surface defined by the ferrite core and the supply magnet layers 13. Completing the end closures of the combination are bucking magnets 19, 19', 21, 21', 23, 23'. The direction of flux in the bucking magnets is as shown by the small arrows indicated interiorly thereof and the flux direction is oriented so as to minimize, towards elimination, any flux leakage from the main ferrite core 11. In structures of this type, miniaturization to a degree hitherto unobtainable can be realized and the devices producable according to such fabricating techniques will find wide application in electronic control circuitry where light weight, economy of materials, and miniaturization are the desiderata.

Figure 2:
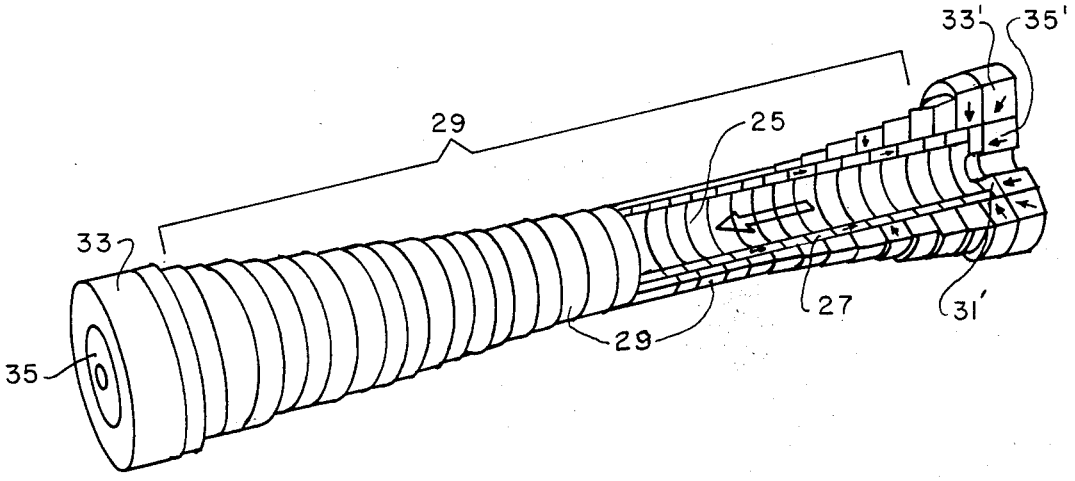

FIG. 2 of the drawing shows an alternative embodiment of apparatus according to my invention wherein the center core element 25 may also be of a ferrite or the like material. A supply magnet 27 layer of electrodeposited or sputtered on material is shown of even thickness, deposited in a series of contiguous uniform annular rings arranged along the longitudinal dimension of the core element 25. Cladding magnet ring 29 are shown arranged in order of diminishing thickness towards the center and arranged concentrically with the core element 11 and the uniform thickness supply magnet 27 layer. The method of applying the electrodeposition by sputtering to achieve this structure can be in any number of ways.

Most conveniently, a center core such as element 25 may be rotated in the region where the rare earth sputtering operation is underway and moved rotatably therein in a series of steps to complete the first layer constituting supply magnet 27. As indicated above, this layer is made up of a series of contiguous uniformly thick annular rings arranged along the longitudinal dimension of the core element 25. At the completion of this step, the apparatus being fabricated may be moved towards one end where one of the thicker cladding magnet rings 29 can be deposited at the end while the core 25 is rotated. After the completion of the desired degree of thickness for the cladding ring element, the device is moved longitudinally to the location of the next ring, which will be of a smaller radial dimension, and so on, until the point of minimal radial dimension is reached at the plane of zero potential, which, in the illustrated embodiment, would be at or near the center point of the apparatus.

To complete the structure illustrated in FIG. 2 of the drawing, closure disks 31, 31' of soft iron or the like material are fitted over the ends of the supply magnet element 27. In addition to the closure disks 31, 31', bucking magnets 33, 33' and 35, 35' are arranged and disposed as shown. The bucking magnets are installed in such a way that their flux aids in and enhances the propagation of the main magnetic field, as the small arrows in these bucking magnets indicate. The complete assembly, with the closure disks and bucking magnets in place, constitutes a permanent magnet assembly which is uniquely suitable for containment and control of small zone magnetic fields without any significant or substantial loss in flux. It should also be noted, importantly, that the utililization of this sputtering technique as described hereinabove permits the fabrication of extremely small permanent magnet devices of this type.

The exact dimensions and configurations of the magnet thicknesses, ratios of length to radii, and magnetic flux potential design establishment, are all considered to be well within the skill of persons conversant with this art. It is therefore considered that the foregoing disclosure of my invention be construed in a general and illustrative sense and not taken in any limiting sense, it being the intent to define the invention by the appended claims.

What is claimed is:

1. A magnetic device comprising, in combination;

an elongate core.

a first permanent magnet sheath of substantially uniform thickness surrounding said core and coextending longitudinally therewith;

a second permanent magnet sheath of substantially uniformly varying thickness coextending longitudinally with said core and said first sheath, radially thicker at each end of said device and diminishing in thickness towards and to the center of the longitudinal dimension of the device; and bucking magnets arranged at each end of the device.

2. Apparatus according to claim 1 wherein the flux orientation in the first permanent magnet sheath is in a direction parallel to and extending longitudinally with the magnetic field flux of the device; and said second permanent magnetic sheath flux orientation is transverse to the flux orientation of said first sheath.

3. Apparatus according to claim 1 wherein the elongate core element is generally cylindrical in form, the first permanent magnet sheath is comprised of a series of annular rings contiguous each to the other and extending along said core to constitute a permanent magnet of uniform thickness; and said second permanent magnet sheath is constituted of a multiplicity varying radially thickness rings coaxially arranged along the longitudinal length of said first permanent magnet sheath and said elongate core, the thickness of said rings varying from the ends of the device towards and to the center thereof in a direction of diminishing thickness.

4. Apparatus according to claim 1 wherein said first permanent magnet sheath and said second permanent magnet sheath are electro-deposited on said elongate core.

5. Apparatus according to claim 3 in combination with ferrite closure end plates and bucking magnets with a flux orientation substantially in alignment with the direction of the magnetic field of the device.

* * * * *